United States Patent [19]

Monbaliu et al.

[11] 4,128,427

[45] Dec. 5, 1978

[54] SILVER HALIDE EMULSIONS CONTAINING POLYMERIC COLOR COUPLERS

[75] Inventors: Marcel J. Monbaliu, Mortsel; Raphaël K. Van Poucke, Berchem, both of Belgium

[73] Assignee: AGFA-GEVAERT, N.V., Mortsel, Belgium

[21] Appl. No.: 803,600

[22] Filed: Jun. 6, 1977

[30] Foreign Application Priority Data

Jun. 15, 1976 [GB] United Kingdom ..... 24779/76

[51] Int. Cl.$^2$ ..... G03C 1/40

[52] U.S. Cl. ..... 96/100 R; 96/114

[58] Field of Search ..... 96/100, 56.5, 114

[56] References Cited

U.S. PATENT DOCUMENTS

| | | | |
|---|---|---|---|
| 3,580,722 | 5/1971 | Sakamoto et al. | 96/100 |
| 3,912,513 | 10/1975 | Monbaliu et al. | 96/56.5 |
| 3,926,436 | 12/1975 | Monbaliu et al. | 96/100 |

FOREIGN PATENT DOCUMENTS

| | | | |
|---|---|---|---|
| 2,044,992 | 3/1972 | Fed. Rep. of Germany | 96/100 |

*Primary Examiner*—J. Travis Brown

*Attorney, Agent, or Firm*—A. W. Breiner

[57] ABSTRACT

Polymeric color couplers with improved light stability comprising in addition to color coupler units, competing coupler units and one or more copolymerized non-coupling monomeric units, thereof the weight ratio of the color coupler units to the competing coupler units is between 10:1 and 1:2 and the weight ratio of the copolymerized non-coupling monomeric units is at least 5%.

7 Claims, No Drawings

SILVER HALIDE EMULSIONS CONTAINING POLYMERIC COLOR COUPLERS

The present invention relates to polymeric compounds capable of oxidative coupling with aromatic primary amino compounds, more particularly to polymeric couplers for use in photographic silver halide colour material and to photographic colour materials containing the polymeric couplers.

It is known that for the production of a photographic colour image in a light-sensitive silver halide layer, the exposed silver halide is developed to a silver image by means of an aromatic primary amino compound in the presence of a colour coupler which reacts with the oxidized developing substance to form a dyestuff image corresponding to the silver image.

In the subtractive multicolour photography a light-sensitive photographic colour material is used containing a red sensitized, a green sensitized and a blue sensitive silver halide emulsion layer, wherein on colour development, by use of appropriate colour couplers, a cyan, a magenta and a yellow dyestuff image is formed.

It is common practice to use for the formation of the cyan dyestuff image phenol or naphthol colour couplers, for the formation of the magenta dyestuff image 2-pyrazolin-5-one colour couplers and for the formation of yellow dyestuff image open-chain ketomethylene couplers containing a methylene group having two carbonyl groups attached to it.

It is known to employ besides colour couplers wherein the coupling position is unsubstituted, requiring thus for the formation of one molecule of dyestuff the development of four molecules of exposed silver halide, colour couplers wherein the coupling position carries a substituent, that is split off open colour development so that only two exposed silver halide molecules should be developed to form one molecule of dyestuff. The former are known as 4-equivalent colour couplers whereas the latter are known as 2-equivalent colour couplers.

It is also known to improve colour reproduction in photographic colour elements by incorporating therein so-called competing couplers which react with the oxidation products of the colour developer agent to form colourless compounds. In G.B. Pat. Nos. 861,138 and 914,415 and in the published German Patent Application DT-OS No. 1,909,067, 2-pyrazolin-5-one competing couplers have been described, which carry at the coupling position an alkyl group. Competing couplers are used in the instances, where such undesirable oxidation products should be rendered ineffective so that the degradation of the colour image quality is inhibited.

Colour couplers should meet various requirements, e.g. it is essential that they possess favourable spectral properties and produce on colour development dyestuff images having a high stability against light, temperature and humidity during a considerable long time.

Colour couplers and competing couplers, when incorporated in photographic light-sensitive silver halide material, should remain immobile and should not wander or diffuse through the material from their original site. Besides colour couplers and competing couplers carrying in their molecule a long chain aliphatic group to prevent diffusion, it has also been proposed e.g. in B.E. Pat. No. 689,971 and in U.S. Pat. No. 3,912,513 to use polymeric colour couplers and competing couplers, obtained by the polymerization of monomeric couplers.

Polymeric couplers are preferably used in the form of latices obtained by emulsion polymerization techniques with the aid of usual addition polymerization initiators.

The incorporation of Polymeric couplers in hydrophilic colloid compositions in the form of latices have important advantages over the incorporation of the polymeric or non polymeric couplers in the form of solutions in water, water miscible solvents or water-immiscible solvents.

Indeed, latices may contain a high percentage of polymer e.g. concentrations up to 50%, and nevertheless still possess a relatively low viscosity; when incorporating said latices into emulsions the viscosity of the latter is not influenced. Moreover, by the use of latices there can be dispensed with the use of organic solvents or alkaline solutions as well as with special dispersing techniques for incorporating the coupler compounds.

In the published German Patent Application No. 2,044,992 polymeric couplers are prepared by reaction of carboxyl groups containing polymers with non-polymeric coupler compounds including colour couplers and competing couplers containing amino groups. It has also been mentioned that the method could be used to provide in one polymeric molecule colour coupler as well as competing coupler units. According to the method of this application no latices can be prepared and the carboxyl groups containing polymers are to be incorporated in the gelatin emulsions from aqueous alkaline solutions whereby the viscosity is markedly increased.

It has now been found that latices of polymeric couplers comprising besides colour coupler units also competing coupler units in the ratios given hereinafter, not only have the advantage of combining in one compound a colour coupler and a competing coupler, but yield upon colour development dyestuff images having a stability against light higher than latices of the corresponding polymeric colour couplers without competing coupler units even when the latter are used in combination with separate competing couplers.

The present invention provides latices of polymeric colour couplers of improved light stability comprising (1) from 10 to 60% by weight, preferably from 20 to 40% by weight of colour coupler recurring units corresponding to the following structural formula I:

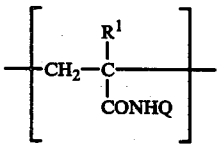

I.

wherein $R^1$ is hydrogen, alkyl preferably $C_1$–$C_4$ alkyl or chlorine and Q is a colour coupler residue capable of coupling with an oxidized aromatic primary amino colour developing agent to form a dye, more particularly a cyan-forming phenol or naphthol colour coupler residue, a yellow-forming acylacetamide colour coupler residue or a magenta-forming pyrazolone or indazolone colour coupler residue, (2) from 5 to 50% by weight, preferably from 10 to 20% by weight of competing coupler recurring units forming upon oxidative coupling with an oxidized aromatic primary amino colour developing agent, colourless compounds and corresponding to the following structural formula II:

II.

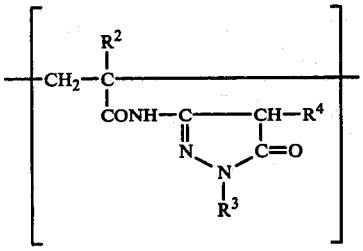

where $R^2$ has one of the significances given for $R^1$, $R^3$ represents a substituent of the type well known in the 1-position of a 2-pyrazolin-5-one competing coupler, more particularly alkyl including substituted alkyl and aryl including substituted aryl and $R^4$ represents a $C_1$–$C_5$ alkyl group including a substituted $C_1$–$C_5$ alkyl group, and (3) at least 5% by weight of one or more copolymerized ethylenically unsaturated monomer units that are not capable of oxidative coupling with the aromatic primary amino developing compounds, the weight ratio of the colour coupler recurring units I to the competing coupler recurring units II being between 10:1 and 1:2 (preferably between 1:1 or 4:1).

More particularly the polymeric colour couplers of the present invention comprise recurring colour coupler units of the above structural formula I wherein the colour coupler residue Q capable of coupling with an oxidized aromatic primary amino colour developing agent, is a member selected from (a) a residue of a cyan-forming colour coupler of the phenol or naphthol type e.g. of the formula:

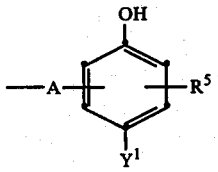

wherein

A is a single chemical bond or a bivalent organic group linking the colour coupler residue to the NH group of formula I, $R^5$ represents hydrogen, a substituent of the type well known in phenol or naphthol colour couplers such as halogen alkyl including substituted alkyl or aryl including substituted aryl, or the atoms necessary to complete a fused-on benzene nucleus which may be substituted, and $Y^1$ represents a hydrogen atom in the case of 4-equivalent couplers or a well-known substituent which splits off upon colour development thus conferring to the colour coupler a 2-equivalent character e.g. a halogen atom such as chlorine, a sulpho group, an acyloxy group, an alkoxy, aryloxy, or heterocycloxy group, an alkylthio, arylthio or heterocyclic thio group such as tetrazolylthio group, a phenylazo group etc.

(b) a residue of a yellow forming colour coupler of the acylacetamide type, especially the acylacetanilide type for example an anilino carbonylacetophenyl group, a benzoylacetamidophenyl group, or a pivaloylacetamidophenyl group, wherein the aryl groups may be substituted by substituents well known in yellow-forming colour couplers e.g. alkyl, alkoxy, halogen, alkylthio, alkylsulphonyl, sulphamoyl, including substituted sulphamoyl, carbamoyl, including substituted carbamoyl etc. and wherein the active methylene group may carry a well known substituent conferring to the colour coupler a 2-equivalent character e.g. a halogen atom such as chlorine, acyloxy, an alkoxy, aryloxy or heterocycloxy group, an alkylthio, arylthio or heterocyclic thio group, a 4-monoalkyl-3-pyrazoline-5-one group linked through its 2-position, as described in Belgian Pat. No. 843,896, a 1,3-dialkyl-2,6-dioxo-7-purinyl group as described in the published German Patent Application No. 2,559,190 and a variety of other heterocyclic groups as described in the published German Patent Applications Nos. 2,057,941; 2,163,812; 2,213,461; 2,318,807; 2,329,587; 2,363,675; 2,414,006 and 2,433,812 etc.

(c) preferably a residue of a magenta-forming colour coupler of the pyrazolone or indazolone type e.g. of the formula:

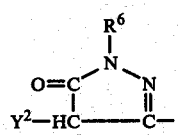

wherein:

$R^6$ is a substituent of the type well-known in the 1-position of 2-pyrazolin-5-one colour couplers e.g. alkyl including substituted alkyl e.g. haloalkyl such as fluoroalkyl, cyanoalkyl and benzyl, or aryl including substituted aryl e.g. phenyl which may be substituted by alkyl, halogen e.g. chlorine, alkoxy, haloalkoxy, alkyl sulphonyl, haloalkyl sulphonyl, alkylthio, haloalkylthio, sulpho, etc., and $Y^2$ is hydrogen in the case of 4-equivalent couplers or a well-known substituent which splits off upon colour development thus conferring to the colour coupler a 2-equivalent character e.g. a halogen atom such as chlorine, an acyloxy group, an alkoxy group, an aryloxy group or a heterocycloxy group, an alkylthio group, an arylthio group or a heterocyclic thio group such as tetrazolylthio, a phenylazo group, etc.

The recurring competing coupler units of the above structural formula II are more particularly those wherein $R^2$ represents hydrogen, $C_1$–$C_4$ alkyl e.g. methyl or chlorine, $R^3$ represents a substituent of the type well known in the 1-position of 2-pyrazolin-5-one colour couplers e.g. alkyl, especially $C_1$–$C_5$-alkyl, which may be substituted e.g. by fluoro such as 2,2,2-trifluoroethyl, cyano such as cyanoethyl and aryl such as benzyl and substituted benzyl, or preferably aryl e.g. phenyl which may be substituted e.g. phenyl substituted by alkyl such as methyl, halogen such as chlorine and bromine, sulpho, alkoxy such as methoxy, alkylsulphonyl such as methylsulphonyl, alkylthio such as methylthio, haloalkyloxy, haloalkylthio, haloalkylsulphonyl, and $R^4$ represents a $C_1$–$C_5$ alkyl group including a substituted $C_1$–$C_5$ alkyl group e.g. benzyl, $R^4$ being preferably methyl.

The copolymerized ethylenically unsaturated monomer units that are not capable of oxidative coupling with aromatic primary amino compounds are preferably one or more members selected from copolymerized acrylic acid, α-chloro acrylic acid, α-alkacrylic acid e.g. methacrylic acid, the esters and amides preferably lower alkyl esters and amides derived from these acrylic acids e.g. acrylamide, methacrylamide, t-butylacrylamide, ethyl acrylate, n-butyl acrylate, 2-ethylhexyl acrylate, and lauryl methacrylates, vinyl esters such as vinyl acetate, vinyl propionate, and vinyl laurate, acrylonitrile, methacrylonitrile, aromatic vinyl compounds, such as styrene and its derivatives e.g. vinyl toluene, divinyl benzene, vinyl acetophenone, and sulphostyrene, itaconic acid, citraconic acid, crotonic acid, vinylidene chloride, vinyl alkyl ethers, such as vinyl ethyl ether, maleic acid esters, N-vinyl-2-pyrrolidone, N-vinylpyridine, 2- and 4-vinylpyridine, etc. Two or more of the above comonomeric compounds can be used together e.g. n-butyl acrylate and divinylbenzene, styrene and methacrylic acid, n-butylacrylate and methacrylic acid, etc.

As is known in the art of polymeric colour couplers, the ethylenically unsaturated monomers for being copolymerized with the monomeric coupler compounds can be chosen so that the physical and/or chemical properties of the resulting copolymer e.g. its solubility, its compatibility with the binder of the photographic colloid composition e.g. gelatin, its flexibility, its thermal stability etc., are favourable influenced.

Through the colour coupler units dyestuffs are formed which should have favourable spectral properties and high stability so that the substituents on the colour coupler units can be selected from those known in the art to meet these requirements and to favour the coupling activity. The competing coupler units, however, form colourless moieties so that the substitutents on the competing coupler units are of minor importance in so far as they do not impair the coupling activity to a noteworthy extent.

The polymeric couplers used in the present invention are prepared by emulsion polymerisation techniques according to which latices are obtained which can be used as such for incorporating the polymeric couplers into light-sensitive materials. Interesting emulsion polymerisation techniques are for instance described in Belgian Pat. 669,971 filed Sept. 22, 1965 by du Pont de Nemours, according to which latices are formed of polymeric colour couplers by emulsion polymerisation in aqueous gelatin, and in United Kingdom Pat. No. 1,130,581 filed June 23, 1964 by Gevaert Photo-Producten N.V. according to which latices are formed of polymeric colour couplers by emulsion polymerisation in water.

These and other data including e.g. examples of polymerisation initiators, emulsifying agents and suitable solvents as well as instructions relating to the formation of the initial emulsions and/or suspensions are set forth in the aforementioned United Kingdom Pat. No. 1,130,581.

Amongst the polymerisation initiators suitable for use in the above emulsion polymerisation process may be mentioned: persulphates such as ammonium and potassium persulphate, azonitrile compounds such as 4,4'-azo-bis(4-cyanovaleric acid) as well as peroxide compounds such as benzoyl peroxide, hydrogen peroxide.

As is described in the above United Kingdom Patent surface active compounds of various classes and known per se are available for use as emulsifying agents, amongst others soaps, sulphonates and sulphates, cationic and amphoteric compounds and high molecular weight protective colloids.

The latices obtained generally comprise between about 2 and about 50% by weight of polymeric coupler in respect of the total amount of latex.

The polymeric colour couplers according to the present invention can be characterized by their so-called equivalent molecular weight with respect to colour coupling monomer. By equivalent molecular weight is understood the number of grams of polymer containing 1 mole of polymerized monomeric colour coupler. It can be compared with the molecular weight of the non-polymeric classical non-migratory colour couplers. The equivalent molecular weight of the polymeric colour couplers according to the invention can vary within very wide limits, preferably from about 250 to 2000.

Examples of monomeric couplers suitable for copolymerization to form polymeric colour couplers according to the present invention can be found in the literature e.g. in Belgian Pat. Nos. 584,494; 602,516 and 669,971, in British Pat. Nos. 967,503; 1,130,581; 1,247,688 and 1,269,355, in U.S. Pat. Nos. 3,356,686 and 3,767,412 and in the published German Patent Application No. 2,304,319.

Representative examples are:

2-methylsulphonylamino-5-methacrylaminophenol
2-methylsulphonylamino-4-chloro-5-methacrylaminophenol
2-phenylsulphonylamino-5-methacrylaminophenol
2-(4-chlorophenyl) sulphonylamino-5-methacrylaminophenol
2-(4-sec.butylphenyl) sulphonylamino-5-methacrylaminophenol
2-ethoxycarbonylamino-5-methacrylaminophenol
2-n-butylureido-5-methacrylaminophenol
2-benzoylamino-5-methacrylaminophenol
2-o-methylbenzoylamino-5-methacrylaminophenol
2-acetylamino-5-methacrylaminophenol
2-p-methoxybenzoylamino-5-methacrylaminophenol
2-o-chlorobenzoylamino-5-methacrylaminophenol
2-p-t.butylbenzoylamino-5-methacrylaminophenol
1-hydroxy-N-β-acrylamidoethyl-2-naphthamide
1-hydroxy-N-β-vinyloxyethyl-2-naphthamide
1-hydroxy-4-chloro-N-β-methacrylamidoethyl-2-naphthamide
1-hydroxy-4-chloro-N-β-acrylamidoethyl-2-naphthamide
2-methacrylamido-4,6-dichloro-5-methylphenol
1-benzyl-3-methacrylamido-2-pyrazolin-5-one
1-(2-cyanoethyl)-3-methacrylamido-2-pyrazolin-5-one
1-(3,4-dichlorobenzyl-3-methacrylamido-2-pyrazolin-5-one
1-(2,2,2-trifluoroethyl)-3-methacrylamido-2-pyrazolin-5-one
1-p-(1,1,2-trifluoro-2-chloroethoxy)phenyl-3-methacrylamido-2-pyrazolin-5-one
1-phenyl-3-methacrylamido-2-pyrazolin-5-one
1-p-methylsulphonylphenyl-3-methacrylamido-2-pyrazolin-5-one
1-o-bromophenyl-3-methacrylamido-2-pyrazolin-5-one 1-m-chlorophenyl-3-methacrylamido-2-pyrazolin-5-one
1-(2,4,6-trichlorophenyl)-3-acrylamido-2-pyrazolin-5-one
p-methacrylamidobenzoylacetanilide
N-[3-methoxy-4-(o-methoxybenzoylacetylamino)]-methacrylamide
p-methacrylamido-benzoylacetanilide
2-chloro-4-methacrylamido-benzoylacetanilide
1-phenyl-3-methacrylamido-4-methyl-2-pyrazolin-5-one
1-phenyl-3-acrylamido-4-methyl-2-pyrazolin-5-one
1-p-methylsulphonylphenyl-3-methacrylamido-4-methyl-2-pyrazolin-5-one
1-(2-chloro-4-methylsulphonylphenyl)-3methacrylamido-4-methyl-2-pyrazolin-5-one
1-(2,4,6-trichlorophenyl)-3-methacrylamido-4-methyl-2-pyrazolin-5-one
1-m-chlorophenyl-3-methacrylamido-4-methyl-2-pyrazolin-5-one
1-benzyl-3-methacrylamido-4-methyl-2-pyrazolin-5-one.

The following preparations illustrate how the polymeric couplers can be made.

Preparation 1

The latex of the copolymer of 1-(4-methylsulphonyl phenyl)-3-methacryloylamino-2-pyrazolin-5-one, 1-phenyl-3-methacryloylamino-4-methyl--2-pyrazolin-5-one and n-butylacrylate were prepared as follows: 500 ml of demineralised water, 20 g of 1-(4-methylsulphonylphenyl)-3-methacryloyamino-2-pyrazolin-5-one, 7 g of 1-phenyl-3-methacryloylamino-4-methyl-2-pyrazolin-5-one, and 10 g of sodiumoleylmethyltauride were introduced in a reaction vessel fitted with a stirrer, a thermometer, a reflux condensor and three dropping funnels. The suspension was heated to 70° C. with stirring, whereafter 40 g of n-butylacrylate were added at once. The temperature was raised to 90° C. and 35 ml of a 1% by weight aqueous solution of the sodium salt of 4,4'-azo-bis(4-cyanovaleric acid) were added. While the temperature was raised to 95° C. the polymerisation reaction started after 5 min.

During a period of 30 min the following ingredients were added uniformly: 80 g of n-butylacrylate, 65 ml of a 1% by weight aqueous solution of the sodium salt of 4,4'-azo-bis(4-cyanovaleric acid), an aqueous dispersion containing 40 g of 1-(4-methylsulphonylphenyl)-3-methacryloylamino-2-pyrazolin-5-one, 13 g of 1-phenyl-3-methacryloylamino-4-methyl-2-pyrazolin-5-one, and 2.65 g of the sodium salt of oleylmethyltauride dissolved in 400 ml of demineralized water. The latter dispersion was obtained by mixing both monomeric compounds (53 g) with 530 g of purified Ottawasand, 26.5 ml of a 10% by weight aqueous solution of the sodium salt of oleylmethyltauride and 63.5 ml of demineralized water and then by mixing the reaction mixture in a sand mill for 4 h. Subsequently, the sand was filtered of, washed with demineralized water, and the filtrate (=dispersion) was brought to a volume of 400 ml with demineralized water.

After all of the reagents had been added to the reaction mixture, it was stirred for 30 min more at boiling temperature, which eventually attained approximately 99° C. From the latex, 100 ml of liquid were evaporated to evacuate unreacted n-butyl acrylate. The latex was filtered upon cooling to separate a small amount of residue.

Yield: 735 g of latex.

The amount of solids per 100 g of latex was 22.3 g.

The amount of polymer per 100 g of latex was 20.8 g.

The equivalent molecular weight calculated in respect of the colour coupling monomer was 1205.

By analysis it was determined that the copolymer comprised 29.3% by weight of colour coupling units, 6.9% by weight of competing coupler units and 63.8% by weight of non-coupling units.

Preparation 2

The latex of the copolymer of 1-phenyl-3-methacryloylamino-2-pyrazolin-5-one, 1-(4-methylsulphonyl-phenyl)-3-methacryloylamino-4-methyl-2-pyrazolin-5-one, styrene and methacrylic acid was prepared by stirring 300 ml of demineralized water, 30 g of 1-phenyl-3-methacryloylamino-2-pyrazolin-5-one, 30 g of 1-(4-methylsulphonylmethyl)-3-methacryloylamino-4-methyl-2-pyrazolin-5-one, and 5 g of sodium oleylmethyltauride in a reaction vessel, fitted with a thermometer, a reflux condenser and two dropping funnels.

The suspension was heated to 75° C. and admixed with a mixture of 10 g of styrene and 3.5 g of methacrylic acid. The temperature was raised to 90° C., whereafter 12.5 ml of a 1% by weight aqueous solution of the sodium salt of 4,4'-azo-bis(4-cyanovaleric acid) was added. While the temperature was raised to 95°–96° C. polymerisation started. Over a period of 30 min a mixture of 20 g of styrene, 6.5 g of methacrylic acid, and 37.5 ml of a 1% by weight aqueous solution of the sodium salt of 4,4'-azo-bis(4-cyanovaleric acid) was added.

The latex was stirred for another 30 min at boiling temperature and was filtered on cooling.

Yield: 400 ml of latex.

The amount of solids per 100 ml of latex was 20.4 g.

The amount of polymer per 100 ml of latex was 19.1 g.

The equivalent molecular weight calculated in respect of the colour coupling monomer was 815.

By analysis it was determined that the copolymer comprised 30% by weight of colour coupler units, 30% by weight of competing coupler units and 40% by weight of non colour coupler units (27.5% of styrene and 12.5% of methacrylic acid units).

Preparation 3

The latex of the copolymer of 1-(3-chlorophenyl)-3-methacryloylamino-2-pyrazolin-5-one, 1-phenyl-3-methacryloylamino-4-methyl-2-pyrazolin-5-one and butylacrylate was prepared as follows: according to the method described in preparation 2, 40 g of 1-(3-chlorophenyl)-3-methacryloyl-amino-2-pyrazolin-5-one, 20 g of 1-phenyl-3-methacryloylamino-4-methyl-2-pyrazolin-5-one, and 40 g of butylacrylate were polymerized in 500 ml of demineralized water with 5 g of sodium oleylmethyltauride and 50 ml of a 1% by weight of the sodium salt of 4,4'azo-bis(4-cyanovaleric acid).

Yield: 400 g of latex.

The amount of solids per 100 g latex was 18.9 g.

The amount of polymers per 100 g latex was 17.5 g.

The equivalent molecular weight in respect of the colour coupling monomer was 816.

By analysis it was determined that the copolymer comprised 34% by weight of colour coupler units, 23.5% by weight of competing coupler units and 42.5% by weight of non coupling units.

Preparation 4

The latex of the copolymer of 1-phenyl-3-methacryloylamino-2-pyrazolin-5-one, 1-phenyl-3-methacryloylamino-4-methyl-2-pyrazolin-5-one and ethylacrylate was prepared analoguously to that described in preparation 2. 240 g of 1-phenyl-3-methacryloylamino-2-pyrazolin-5-one, 120 g of 1-phenyl-3-methacryloylamino-4-methyl-2-pyrazolin-5-one, and 240 g of ethyl acrylate were polymerized in 1800 ml of demineralized water by means of 30 g of sodium oleylmethyltauride and 300 ml of a 1% by weight aqueous solution of the sodium salt of 4,4'-azo-bis(4-cyanovaleric acid).

Yield: 2565 g of latex.

The amount of solids per 100 g of latex was 23 g.

The amount of polymers per 100 g of latex was 21.7 g.

The equivalent molecular weight in respect of the colour coupling monomer was 588.

By analysis it was determined that the copolymer comprised 41.3% by weight of colour coupler units, 20.6% by weight of competing coupler units and 38.1% by weight of non-coupling units.

Preparation 5

The latex of the copolymer of 1-(2,4,6-trichlorophenyl)-3-methacryloylamino-2-pyrazolin-5-one, 1-phenyl-3-methacryloylamino-4-methyl-2-pyrazolin-5-one and butylacrylate was prepared as described in preparation 2 with the difference that the following compounds were used.

30 g of 1-(2,4,6-trichlorophenyl)3-methacryloylamino-2-pyrazolin-5-one, 30 g of 1-phenyl-3-methacryloylamino-4-methyl-2-pyrazolin-5-one, 40 g of butyl acrylate, 5 g of sodium oleylmethyltauride, and 50 ml of a 1% by weight aqueous solution of the sodium salt of 4,4'-azo-bis(4-cyanovaleric acid) in 400 ml of demineralized water.

The yield was 300 ml of latex.

The amount of solids per 100 ml of latex was 22 g.

The amount of polymers per 100 ml of latex was 19.3 g.

The equivalent molecular weight in respect of the colour coupling monomer was 1533.

Preparation 6

The latex of the copolymer of 1-benzyl-3-methacryloylamino-2-pyrazolin-5-one, 1-(4-methylsulphophenyl)-3-methacryloylamino-4-methyl-2-pyrazolin-5-one and n-butylacrylate was prepared as described in preparation 1 with the difference that the following compounds were used: 24.9 g of 1-benzyl-3-methacryloylamino-2-pyrazolin-5-one, 8.3 g of 1-(4-methylsulphonylphenyl)-3-methacryloylamino-4-methyl-2-pyrazolin-5-one, 49.8 g butyl acrylate, 4.15 g of the sodium salt of oleylmethyltauride and 41.5 ml of a 1% by weight aqueous solution of the sodium salt of 4,4'-azo-bis(4-cyanovaleric acid) in 300 ml of demineralized water.

Yield: 310 ml of latex.

The amount of solids per 100 ml of latex was 22.6 g.

The amount of polymers per 100 ml of latex was 21.1 g.

The equivalent molecular weight calculated in respect of the colour coupling monomer was 768.

Preparation 7

The latex of the copolymer of 1-phenyl-3-methacryloylamino-2-pyrazolin-5-one, 1-phenyl-4-methyl-3-methacryloylamino-2-pyrazolin-5-one, styrene and methacrylic acid was prepared as follows:

in a reaction vessel fitted with a thermometer, a reflux condensor and three dropping funnels 1400 ml of demineralized water (wherein 12 g of sodium oleylmethyltauride was dissolved) was heated until 95° C. Subsequently 70 ml of a 1% by weight aqueous solution of the sodium salt of 4,4'-azo-bis(4-cyanovaleric acid) were introduced, as well as 48 g of a mixture of equal parts by weight of methacrylic acid and styrene and aqueous monomeric suspension of 48 g of 1-phenyl-3-methacryloylamino-2-pyrazolin-5-one, 24 g of 1-phenyl-4-methyl-3-methacryloylamino-2-pyrazolin-5-one, 150 ml of demineralised water and 3.6 g of sodium oleylmethyltauride. Due to this addition the temperature dropped to about 88°–90° C. After some minutes polymerisation started and increased inactively by additional heating to 96° C. At this moment again initiator liquid, monomeric dispersion and liquid comonomer were added in the same amount as mentioned hereinbefore. The temperature first dropped to 88° C., and was increased to 96° C. The procedure of addition of the ingredients was repeated three times. Thereafter the mixture was refluxed for ¾ h. The latex was cooled to 20° C. and filtered.

Yield: 2676 g of latex.

The amount of solids per 100 ml of latex was 20.9 g.

The amount of polymer per 100 ml of latex was 19.6 g.

The equivalent molecular weight calculated in respect of the colour coupling monomer was 617.

By analysis it was determined that the copolymer comprised 39.4% by weight of colour coupling units, 19.7% by weight of competing coupling units and 40.9% by weight of non-coupling units.

The polymeric couplers of the present invention may be used in various kinds of photographic colour materials which include negative, positive as well as reversal material.

The prevent invention thus provides photographic colour materials comprising polymeric couplers as defined hereinbefore. Photographic multilayer colour materials usually comprise a blue-sensitive silver halide emulsion layer with colour coupler for yellow, a green-sensitized silver halide emulsion layer with colour coupler for magenta and a red-sensitized silver halide emulsion layer with colour coupler for cyan. These colour materials may further comprise one or more intermediate layers, filter layers and protective surface layers.

In photographic colour elements, the colour couplers are preferably incorporated in the silver halide emulsion layer, but they may also be used in a hydrophilic colloid layer in water permeable relationship with the emulsion layer.

The hydrophilic colloid used as the vehicle for the silver halide emulsion layer and the other hydrophilic colloid layers may be, for example, gelatin, colloidal albumin, zein, casein, a cellulose derivative, a synthetic hydrophilic colloid such as polyvinyl alcohol, poly-N-vinyl pyrrolidone, etc., gelatin being preferred. If desired compatible mixtures of two or more of these colloids may be employed.

The silver halide emulsion layer may comprise various silver salts as the sensitive salt much as silver bromide, silver chloride, silver chlorobromide, silver bromoiodide and silver chlorobromoiodide.

The photographic colour elements comprising the polymeric couplers of the present invention may comprise as supports paper, glass, cellulose ester film, polyvinyl acetal film, polystyrene film, polyethylene terephthalate film and related films of resinous materials.

In the development of the exposed photographic colour materials aromatic primary amino developing agents are used forming dyestuffs with the colour coupler units and colourless compounds with the competing coupler units of the polymeric couplers of the present invention. Suitable developing agents are p-phenylene diamine and derivatives e.g. N,N-diethyl-p-phenylene diamine, N-butyl-N-sulphobutyl-p-phenylene diamine, 2-amino-5-diethylaminotoluene, 4-amino-N-ethyl-N (β-methane sulphonamidoethyl)-m-toluidine, N-hydroxyethyl-N-ethyl-p-phenylene diamine, etc.

The following examples illustrate the use of the polymeric couplers of the invention in photographic silver halide colour material.

EXAMPLE 1

The polymeric colour couplers listed in the following table were incorporated into a conventional silver iodobromide (2.3 mol % of iodide) emulsion from their latices obtained in the preparations hereinbefore in an amount corresponding to 0.006 mole of polymerised monomeric colour coupler per mole of silver halide.

Emulsion portions were coated on a conventional film support, dried and overcoated with a gelatin antistress layer. After having been dried, the emulsions were exposed through a step-wedge and processed as follows.

The materials were developed for 8 min at 20° C. in a developing bath of the following composition:

| | |
|---|---|
| N,N-diethyl-p-phenylene diamine sulphate | 2.75 g |
| hydroxylamine sulphate | 1.2 g |
| sodium hexametaphosphate | 4 g |
| anhydrous sodium sulphite | 2 g |
| anhydrous potassium carbonate | 75 g |
| potassium bromide | 2.5 g |
| water to make | 1 l |

The developed materials were treated for 2 min at 18°–20° C. in an intermediate bath comprising 30 g of sodium sulphate in 1 l of water.

The materials were rinsed for 15 min with water and treated in a bleach bath of the following composition:

| | |
|---|---|
| borax | 20 g |
| potassium bromide | 15 g |
| anhydrous potassium bisulphate | 4.2 g |
| potassium hexacyanoferrate(III) | 100 g |
| water to make | 1 l |

After bleaching, the materials were rinsed with water for 5 min and fixed in an aqueous solution of 200 g of sodium thiosulphate per liter. After a final rinsing for 15 min the materials were dried.

Magenta coloured wedge images were obtained. As is apparent from the results listed in the following table the magenta wedge images obtained by using colour couplers of the present invention showed superior light stability than the magenta wedges obtained with the corresponding polymeric colour couplers which do not contain the competing coupler recurring units, even when in addition to the latter a polymeric competing coupler is also present in the emulsion.

Table

| polymeric colour coupler (0.006 mole/mole of silver halide) | | percentage density loss* at density 0.5 | density 1.5 |
|---|---|---|---|
| coupler of preparation 1 | | 34 | 26 |
| corresponding polymeric colour coupler without competing coupler units | A | 72 | 53 |
| mixture of polymeric colour coupler latex A and polymeric competing coupler latex B so that the ratio of colour coupler units to competing coupler units is 4.25:1 | | 62 | 42 |
| coupler of preparation 3 | | 18 | 16 |
| corresponding polymeric colour coupler without competing coupler units | C | 22 | 14 |
| coupler of preparation 4 | | 12 | 11 |
| corresponding polymeric colour coupler without competing coupler units | D | 22 | 17 |
| coupler of preparation 7 | | 12 | 18 |
| corresponding polymeric colour coupler without competing coupler units | E | 28 | 24 |

*loss in density on a percentage basis of the magenta wedges measured at density 0.5 and 1.5, after having been exposed for 15 hours to 1500 Watt Xenon-lamp in a Xenotest 150 apparatus of "Original Hanau-Quartz lampen GmbH" Hanau am Main, Germany A = latex of the copolymer of n-butyl acrylate and 1-(4-methylsulphonylphenyl)-3-methacrylamido-2-pyrazolin-5-one (78.4/21.6% by weight)

B = latex of the copolymer of butyl acrylate and 1-phenyl-3-methacrylamino-4-methyl-2-pyrazolin-5-one (28.1/71.9% by weight)

C = latex of the copolymer of n-butyl acrylate and 1-m-chloro-phenyl-3-methacrylamino-2-pyrazolin-5-one (59/41% by weight)

D = latex of the copolymer of ethyl acrylate and 1-phenyl-3-methacrylamido-2-pyrazolin-5-one (57.4/42.6% by weight)

E = latex of the copolymer of styrene, methacrylic acid and1-phenyl-3-methacrylamido-2-pyrazolin-5-one (39.1/21/39.9% by weight)

EXAMPLE 2

Superior light stability was also obtained when exposing and colour processing materials as described in example 1 using other conventional processing solutions based on the developing agents listed in the following table.

| Coupler | Developing agent | Percentage density loss after 15 h at density 0.5 | density 1.5 | ater 30 h at density 0.5 | density 1.5 |
|---|---|---|---|---|---|
| coupler of preparation 1 | 4-amino-3-methyl-N-ethyl-N-(β-hydroxyethyl)aniline sulphate | 34 | 25 | — | — |
| coupler A of example 1 | " | 82 | 57 | — | — |
| coupler A + coupler B of example 1 | " | 80 | 55 | — | — |
| coupler of preparation 1 | 2-amino-5-diethylamino toluene hydrochloride | 24 | 19 | 40 | 30 |
| coupler A of example 1 | " | — | 33 | — | 53 |

-continued

| Coupler | Developing agent | Percentage density loss after 15 h at density 0.5 | after 15 h at density 1.5 | ater 30 h at density 0.5 | ater 30 h at density 1.5 |
|---|---|---|---|---|---|
| coupler A + coupler B of example 1 | " | 42 | 23 | 58 | 44 |
| coupler of preparation 3 | 4-amino-3-methyl-N-ethyl-N-(β-hydroxyethyl)aniline sulphate | 10 | 15 | — | — |
| coupler C of example 1 | " | 38 | 28 | — | — |
| coupler of preparation 3 | 2-amino-5[N-ethyl-N(β-methylsulphonylamino)ethyl ] amino toluene sulphate | 0 | 3 | — | — |
| coupler C of example 1 | " | 22 | 10 | — | — |
| coupler of preparation 3 | 5-amino-5-diethylamino toluene hydrochloride | 8 | 13 | — | — |
| coupler C of example 1 | " | 18 | 13 | — | — |
| coupler of preparation 2 | N-butyl-N-sulphobutyl-p-phenyldiamine | 12 | 18 | 34 | 21 |
| coupler E of example 1 | " | 16 | 14 | 42 | 35 |
| coupler of preparation 2 | 2-amino-5-[ethyl-N-(β-methylenesulphonylamino) ethyl]amino toluene sulphate | 12 | 8 | 28 | 22 |
| coupler E of example 1 | " | 20 | 16 | 46 | 35 |
| coupler of preparation 2 | 2-amino-5-diethylamino toluene hydrochloride | 24 | 16 | 42 | 33 |
| coupler E of example 1 | " | 24 | 21 | 54 | 43 |
| coupler of preparation 4 | 4-amino-3-methyl-N-ethyl-N-(β-hydroxyethyl)aniline sulphate | 12 | 17 | 36 | 30 |
| coupler D of example 1 | " | 34 | 23 | 56 | 40 |
| coupler of preparation 4 | 2-amino-5[N-ethyl-N-(β-methylsulphonylamino) ethyl]aminotoluene sulphate | 8 | 6 | 18 | 17 |
| coupler D of example 1 | " | 18 | 14 | 44 | 33 |
| coupler of preparation 7 | 4-amino-3-methyl-N-ethyl-N-(β-hydroxyethyl)aniline sulphate | 18 | 14 | — | — |
| coupler E of example 1 | " | 26 | 25 | — | — |
| coupler of preparation 7 | 2-amino-5[N-ethyl-N-(β-methylsulphonylamino)ethyl] amino toluene sulphate | 18 | 15 | — | — |
| coupler E of example 1 | " | 28 | 22 | — | — |

We claim:

1. A photographic material comprising at least one silver halide emulsion layer and a latex of polymeric colour coupler wherein the polymeric colour coupler comprises:

(a) from 10 to 60% by weight of colour coupler recurring units corresponding to the following structural formula I

I

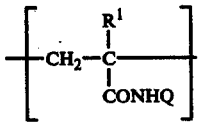

wherein $R^1$ is hydrogen, an alkyl group or chlorine and Q is a colour coupler residue capable of coupling with an oxidized aromatic primary amine colour developing agent to form a dye, and (b) from 5 to 50% by weight of competing coupler recurring units forming upon oxidative coupling with an oxidized aromatic primary amine colour developing agent a colourless compound and corresponding to the following structural formula II

II

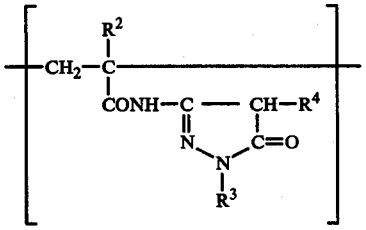

wherein $R^2$ is hydrogen, an alkyl group or chlorine, $R^3$ represents a well known substituent in the 1-position of a 2-pyrazolin-5-one competing coupler and $R^4$ represents a $C_1$–$C_5$ alkyl group, and (c) at least 5% by weight of one or more copolymerised ethylenically unsaturated monomer units that are not capable of oxidative coupling with the aromatic primary amino developing compounds, the weight ratio of the colour coupler recurring units I to the competing coupler units II being between 10:1 and 1:2.

2. A photographic material according to claim 1, wherein the weight ratio of the colour coupler recurring units I to the competing coupler units II is between 1:1 and 4:1.

3. A photographic material according to claim 1, wherein the colour coupler residue Q is a cyan forming phenol or naphthol colour coupler residue, a yellow-forming acylacetamide colour coupler residue or a magenta-forming pyrazolone or indazolone colour coupler residue.

4. A photographic material according to claim 1, wherein the colour coupler residue Q corresponds to the following formula:

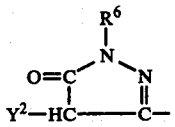

wherein $R^6$ represents a well known substituent in the 1-position of a 2-pyrazolin-5-one colour coupler and $Y^2$ represents hydrogen or a substituent that is split off upon colour development.

5. Photographic material according to claim 4, wherein each of $R^3$ and $R^6$ represents an alkyl group or an aryl group.

6. A photographic material according to claim 1, wherein the colour coupler recurring units are present in an amount from 20 to 40% by weight and the competing coupler recurring units are present in an amount from 10 to 20% by weight.

7. A photographic material according to claim 1, wherein the copolymerised ethylenically unsaturated non-coupling units are one or more members selected from alkyl(meth)acrylates, styrene and (meth)acrylic acid.

* * * * *